US005099574A

United States Patent [19]

Paulman et al.

[11] Patent Number: 5,099,574

[45] Date of Patent: Mar. 31, 1992

[54] METHOD OF MAKING A HEAT EXCHANGER ASSEMBLY WITH WRAPPED TUBING

[75] Inventors: Roger Paulman, Barrington; Franz X. Wohrstein, Park Ridge, both of Ill.

[73] Assignee: Peerless of America, Incorporated, Chicago, Ill.

[21] Appl. No.: 619,869

[22] Filed: Nov. 29, 1990

[51] Int. Cl.[5] ..... B21D 53/00

[52] U.S. Cl. ..... 29/890.044; 29/407; 29/890.046

[58] Field of Search ..... 29/890.046, 890.045, 29/890.042, 890.044, 522.1, 523, 407; 165/150, 176

[56] References Cited

U.S. PATENT DOCUMENTS 2,204,613 6/1940 Nelson et al. ..... 165/150
3,712,372 1/1973 Tranel .
3,780,799 12/1973 Pasternak ..... 165/150
4,241,785 12/1980 O'Connor et al. ..... 165/150 X
4,778,004 10/1988 Paulman et al. ..... 165/150
4,881,311 11/1989 Paulman et al. .

*Primary Examiner*—Irene Cuda
*Attorney, Agent, or Firm*—Emrich & Dithmar

[57] ABSTRACT

A method for forming a heat exchanger assembly including wrapping a one-piece heat exchanger tube onto a heat transfer unit having a plurality of fins on upper and lower surfaces, the fins being provided with notches which are aligned in sets with each set of notches receiving a section of the heat exchanger tube as it is wrapped around the heat transfer array, return bend portions of the heat exchanger tube being formed in the wrapping process to have a generally rectangular cross section to maximize the cross sectional area of the heat exchanger tube in the return bend areas of the tube.

9 Claims, 3 Drawing Sheets

FIG. 1
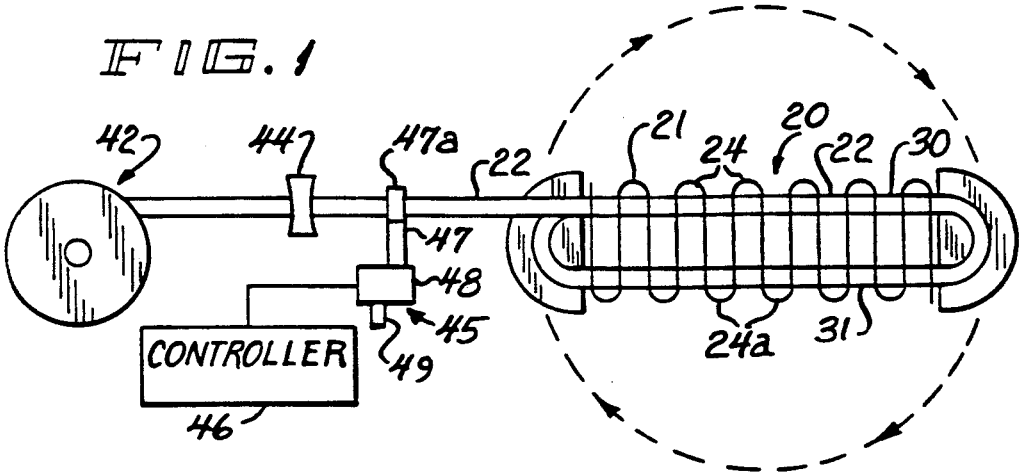
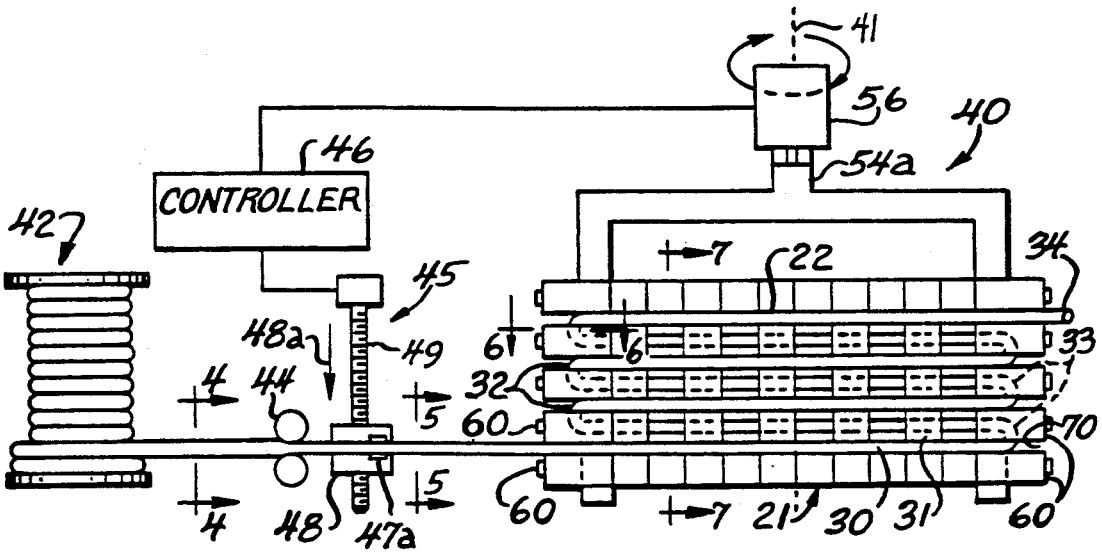
FIG. 2
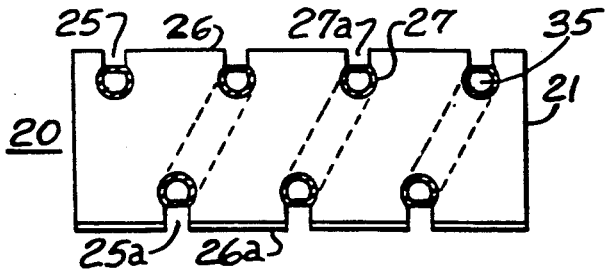
FIG. 3
FIG. 4
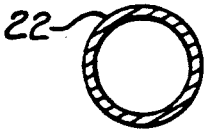
FIG. 5
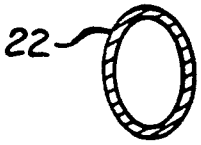
FIG. 6
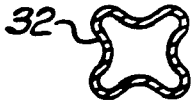

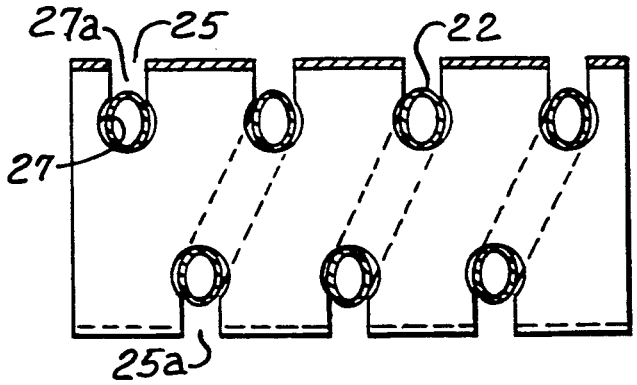
FIG. 7
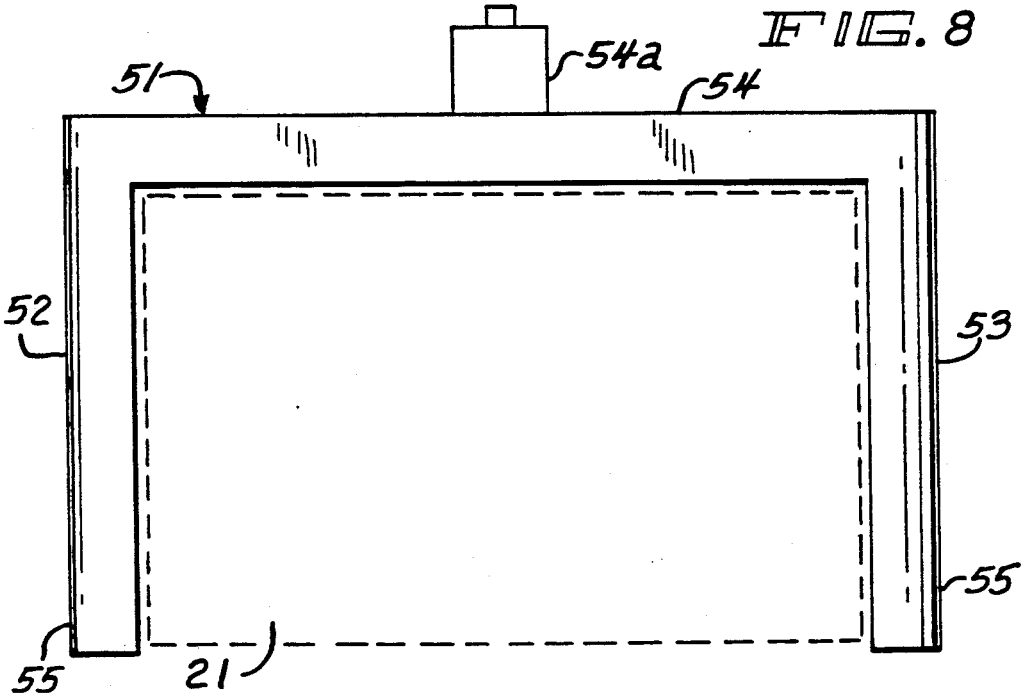
FIG. 8
FIG. 9
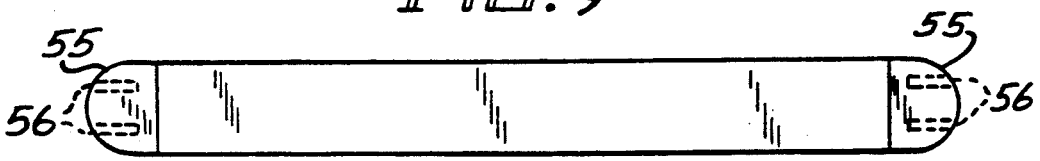
FIG. 10
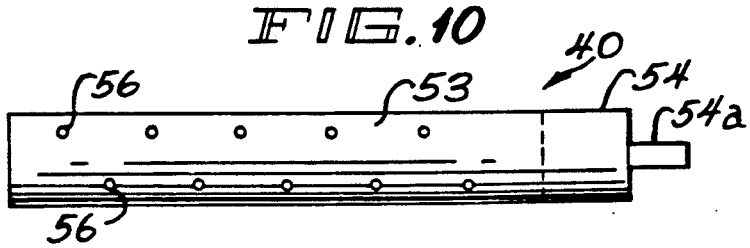

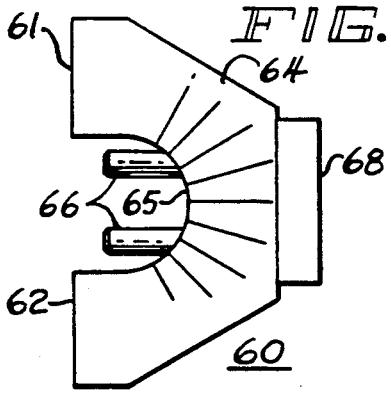
FIG. 11
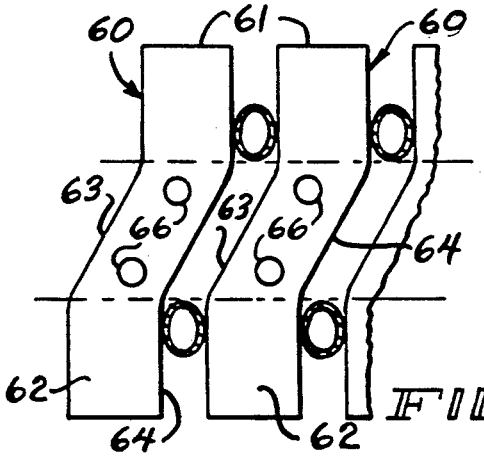
FIG. 12
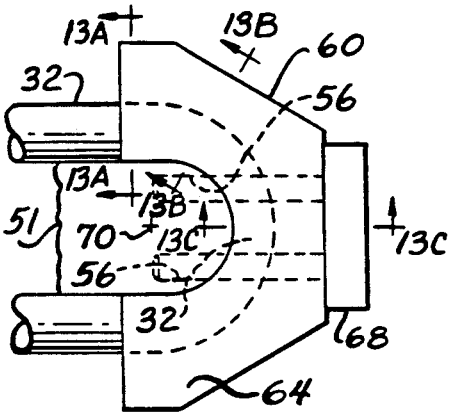
FIG. 13
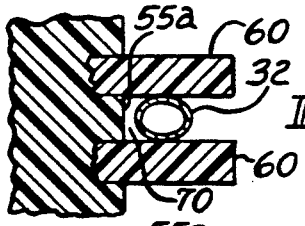
FIG. 13A
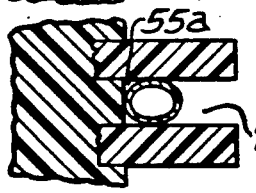
FIG. 13B
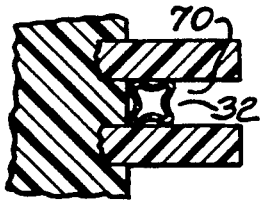
FIG. 13C
FIG. 14
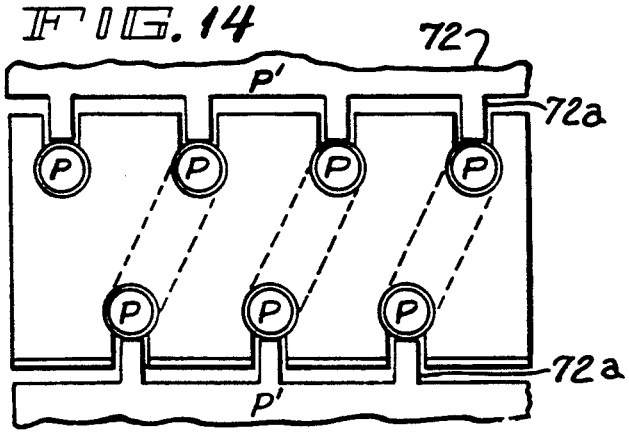
FIG. 15
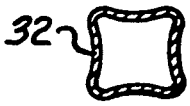
FIG. 16
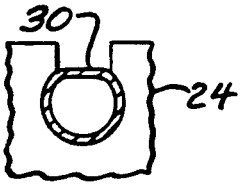

METHOD OF MAKING A HEAT EXCHANGER ASSEMBLY WITH WRAPPED TUBING

BACKGROUND OF THE INVENTION

This invention relates to heat exchangers and more particularly to heat exchangers of the side-entry type and to a method of making the same.

Side-entry type heat exchangers have a plurality of cross-fins with open-ended notches formed in their marginal edge portions. The notches in the cross-fins are aligned in rows, and heat exchanger tubing is inserted transversely into the aligned notches, threading the notches from row to row. The provision of open-ended notches along the marginal edges of the fin arrays enables the use of a one-piece heat exchanger tube.

Although the inner diameter of the notches in the fins corresponds to the outer diameter of the tube, the peripheral contact between the fins and the tube is reduced by at least the width of the open-end portion of the notch through which the heat exchanger tube is inserted into the fin array. Accordingly, to maximize contact between cross-fins and the heat exchanger tube, it is common practice in the manufacture of side-entry type heat exchangers to form the notches with a relatively narrow entry or throat portion leading into a generally circular relatively large diameter portion sized to the outer diameter of the heat exchanger tube. During the assembly of the tube the fin array, the tube is slightly flattened from its circular cross-section to facilitate its insertion transversely through the entry portion of the notch into the circular portion of the notch. The tube is then expanded by subjecting the tube to internal high pressure. Such expansion both interlocks the cross-fins and the tube against removal and enhances peripheral contact between the tube and the fin array.

One known arrangement for assembling a heat exchanger tube on such fin array includes preforming the tube to a helical shape and pressing the preformed tube into the notches of the fin array. Such method of assembly is not well suited for mass production because of the need to insert the fin assembly into the preformed tube, align each pass of the tube with an associated row of notches in the fin array and then press each tube section into its associated notches.

A further consideration is that assembling of a one-piece heat exchanger tube on such fin array requires forming of return bend portions to provide multiple passes of the heat exchanger tube along the surfaces of the fin unit. Although such bending causes "kinking" of the tube, usually any kinks in the return bend portions will be "blown out" when the tube is subjected to internal high pressure during expansion of the tube to engage the side walls of the body portions of the fin assembly. However, some of the portions of the heat exchanger tube which define the return bends may not be returned to their original circular cross-diameter shape, resulting flow restriction in one or several of the return bends, reducing the efficiency of the heat exchanger assembly.

Thus, it would be desirable to have a side-entry type heat exchanger of the type employing a one-piece heat exchanger tube which when assembled with a fin array, is substantially free of flow restriction in return bend portions.

SUMMARY OF THE INVENTION

It is therefore an object of the present invention to provide a method and apparatus for making a heat exchanger assembly of the side-entry type which is easier to manufacture and assemble than heat exchanger assemblies presently available.

Another object of the invention is to provide a method and apparatus for making a heat exchanger assembly which is more compact and more rugged than known heat exchanger assemblies, and which affords increased efficiency while providing a more compact heat exchanger assembly.

Yet another object of the invention is to provide a method and apparatus for wrapping a heat exchanger tube onto a heat transfer array to produce a heat exchanger assembly.

In accordance with the invention, there is provided a method of making a heat exchanger assembly of the type including a heat transfer array having first and second parallel surfaces each defining a plurality of fins, each of the fins having notches which are aligned in sets on the first and second surfaces, and a single length of heat exchanger tube, wherein the tube is applied to the heat transfer array, threading the notches in the fins thereof, defining a first plurality of pass sections threading the notches on the first surface and a second plurality of parallel passes threading the notches on the second surface, and return bend portions interconnecting adjacent pass portions on the first and second surfaces. The method includes the steps of producing relative rotation between the heat transfer array and the tube to cause the tube to be wrapped onto the heat transfer array, indexing the tube relative to the heat transfer array as the tube is being wrapped thereon to direct the tube alternately into a set of notches on the first and second surfaces, maintaining tension on the heat exchanger tube while it is being wrapped around the heat transfer array, threading the notches of the fins thereof to thereby produce a generally rectangular cross section for the tube in the return bend portions with a plurality of inwardly directing rib portions, and, upon completion of the wrapping of the tube on the heat exchanger array, expanding the return bend portions to a generally rectangular shape to maximize the cross sectional area of the tubing in the return bend portions.

Further, in accordance with the invention, there is provided apparatus for producing a heat exchanger assembly of the type including a heat transfer array having first and second parallel surfaces with the fins defined thereon and notches in the fins aligned in sets on the first and second surfaces, and a single length of heat exchanger tube mounted on the heat transfer array and defining pass portions threading the notches on the first and second surfaces and return bend portions interconnecting the pass portions on the first and second surfaces, said apparatus comprising means for producing relative rotation between the heat transfer array and the heat exchanger tube, causing the heat exchanger tube to be wrapped onto the heat transfer array, indexing means for indexing the tube relative to the heat transfer array as the tube is being wrapped thereon to direct the tube alternately into a set of notches on the first and second surfaces, means for maintaining tension on said heat exchanger tube as it is being wrapped onto the heat transfer array, forming means defining the pitch of the return bend portions of the heat exchanger tube as it is being wrapped onto the heat transfer array, the forming means being constructed and arranged to maintain substantially square cross section for the return bend portions during subsequent expansion of the heat exchanger tube.

This invention consists of certain novel features and structural details hereinafter fully described, illustrated in the accompanying drawing, and particularly pointed out in the appended claims, it being understood that various changes in the details may be made without departing from the spirit, or sacrificing any of the advantages of the present invention.

DESCRIPTION OF THE DRAWINGS

For the purpose of facilitating and understanding the invention, there is illustrated in the accompanying drawings a preferred embodiment thereof, from an inspection of which, when considered in connection with the following description, the invention, its construction and operation, and many of its advantages will be readily understood and appreciated.

FIG. 1 is a side elevational view of a simplified representation of a heat exchanger assembly and apparatus for producing the heat exchanger assembly in accordance with the present invention;

FIG. 2 is a top plan view of a simplified representation of the heat exchanger assembly and the apparatus illustrated in FIG. 1;

FIG. 3 is an end view of a heat exchanger assembly produced in accordance with the present invention;

FIG. 4 is a cross-sectional view of the heat exchanger tube taken along the lines 4—4 of FIG. 2;

FIG. 5 is a cross-sectional view of the heat exchanger tube taken along lines 5—5 of FIG. 2;

FIG. 6 is a sectional view of the heat exchanger tube taken along the lines 6—6 of FIG. 2;

FIG. 7 is a sectional view of the heat exchanger assembly taken along the lines 7—7 of FIG. 2;

FIG. 8 is a top plan view of the winding mandrel of the apparatus illustrated in FIG. 1 with a fin unit shown in phantom;

FIG. 9 is a front elevational view of the mandrel illustrated in FIG. 1;

FIG. 10 is a side elevational view of the mandrel illustrated in FIG. 1;

FIG. 11 is a side elevational view of a form member of the apparatus illustrated in FIG. 1;

FIG. 12 is a front elevational view of the form member illustrated in FIG. 11;

FIG. 13 is a side elevational view of a form member and a portion of the winding mandrel cooperating in forming a return bend for the heat exchanger tube;

FIG. 13A is a sectional view taken along the lines 13A—13A of FIG. 13;

FIG. 13B is a sectional view taken along the lines 13B—13B of FIG. 13;

FIG. 13C is a sectional view taken along the lines 13C—13C of FIG. 13;

FIG. 14 is a simplified representation of a heat exchanger assembly illustrating expansion of the pass portions of the tubing during the manufacturing of the heat exchanger assembly;

FIG. 15 illustrates the cross-section of tube return bend portions for the completed heat exchanger assembly; and FIG. 16 illustrates the cross-section of tube pass portions for the completed heat exchanger assembly.

DESCRIPTION OF A PREFERRED EMBODIMENT

Referring to FIGS. 1 and 2, there is shown a simplified representation of a heat exchanger assembly 20 and apparatus for producing the heat exchanger assembly in accordance with the present invention. The heat exchanger assembly 20 shown in FIGS. 1, 2 and 3, includes a heat transfer array or fin unit 21 and a one-piece heat exchanger tube 22. The fin unit defines a plurality of rows of aligned notches or slots 25 and **25*a*, in its upper surface 26 and its lower surface 26*a*, respectively. The single length of tube is wrapped around the fin unit threading or laid in the series of notches 25, 25*a* provided in respective surfaces 26, 26*a* of the fin unit. The fin unit is of the side-entry type and is formed from a single thin sheet of metal, such as aluminum, which is folded back and forth upon itself defining a plurality of fins 24 and 24*a* for the fin unit. Each notch has a circular portion 27 and a narrow throat portion 27*a*. By way of example, the fin unit may be similar to that illustrated in U.S. Pat. No. 4,881,311, having notches in both surfaces or in only one surface as illustrated respectively in FIGS. 9 and 5** of the referenced patent.

The heat exchanger tube 22 is formed of a bendable material, such as aluminum, and preferably consists of a unitary tubular member of circular cross-section having a diameter of about 0.375 inches and a wall thickness of about 0.016 inches. A heat exchanger tube having such dimensions affords sufficient mechanical strength to withstand internal pressure without rupturing while being capable of being compressed when subjected to forces on opposite sides of the tube, to facilitate insertion into the fin units. When the tube 22 is assembled with the fin unit, as shown in FIG. 2, it is formed into a pattern having an upper row of passes 30 and a lower row of passes 31. At the left-hand side of the assembly (as viewed in FIG. 2), the adjacent passes 30 and 31 in each of the upper and lower rows are interconnected at their ends by return bend portions 32 of the one-piece tube 22. Similarly, at the right-hand side of the assembly, the passes 30, 31 in the two rows are interconnected by return bend portions 33. One of the passes extends outwardly beyond the fin unit 21 to define a fluid inlet 34 (FIG. 2) for the tube 22, and one of the passes extends outwardly from the fin unit to define a fluid outlet 35 (FIG. 3) for the tube.

Referring to FIGS. 1 and 2, the apparatus for producing the heat exchanger assembly includes a rotating mandrel 40, shaping apparatus 44, guide apparatus 45 and a plurality of form guide members 60 associated with the mandrel. The mandrel 40 supports the fin unit 21 for rotation about an axis 41 while drawing the tube 22 from a source 42 of tubing. In practice, the source of tubing 42 is located ten to twelve feet away from the winding mandrel. The form guide members 60 are carried by and cooperate with the mandrel to define forming channels which define the pitch of the return bend portions 32 and 33 of the tube 22.

The tube 22 is drawn through the shaping apparatus 44 which compresses the tube vertically as viewed in FIG. 1, to change the shape of the tube from its generally circular cross section as illustrated in FIG. 4 to a generally oval cross section as illustrated in FIG. 5. The tube is flattened slightly to the oval shape to facilitate laying the tube 22 into the notches 25, **25*a* of the fin unit 21, as illustrated in FIG. 7**, as the tube is wrapped onto the fin unit. It is pointed out that tube segments of oval cross section which are pre cut to predetermined lengths could be used rather than continuous length tubing which is cut to the desired length after being wrapped onto the fin unit.

The guide apparatus 45 is operated by a controller 46 and includes a guide arm 47 terminating in guide portion 47*a* which directs and lifts the tube 22, indexing the end of the tube for its insertion into the notches 25, 25*a* as the fin unit 21 is rotated by the mandrel 40. The phrase "end of the tube" means that portion of the tube being inserted into the notches at any given time during the wrapping process. The controller 46 senses the position of the end of the heat exchanger tube 22 as the tube is being laid in each row of notches of the fin unit and repositions the guide arm 47 and the tube carried thereby at the end of each pass. For example, the position of the end of the tube in the fin unit may be correlated to the angular position of the mandrel 40. That is, when the mandrel is oriented horizontally, as illustrated in FIG. 1, the tube is being laid in the middle portion of the row of notches on the upper surface of the fin unit. With 90° of rotation, the mandrel is oriented vertically and a return bend is being formed, etc.

The guide arm 47 is carried by a drive mechanism 48 which rides on a track 49 which extends transversely of the end of the fin unit 21. By way of example, the track 49 may comprise an operating screw arranged to move the drive mechanism 48 and the guide arm 47 forward, in the direction of the arrow 48*a* (FIG. 2) one inch and then backwards one-half inch, a distance corresponding to the separation between adjacent passes of the tube 22 as wound on the fin unit 21. Thus with each forward movement of the drive mechanism 48, the tube is advanced approximately one-half inch in the forward direction so as to be aligned with the next row of notches. The drive mechanism 48 is advanced with each 180° rotation of the rotating mandrel 40 so that the end of the tube is aligned or indexed alternately with the notches on the upper and lower surfaces of the fin unit as the fin unit is rotated by the mandrel 40. The drive mechanism 48 is moved as the fin unit is approaching a generally vertical orientation (i.e., 90° of rotation from the position illustrated in FIG. 1).

Referring to FIGS. 8–12, the rotating mandrel 40 includes a yoke 51 having a pair of support arms 52 and 53 interconnected by a cross member 54. The support arms 52 and 53 are spaced apart sufficiently to receive the fin unit 21 therebetween. The folded fin unit 21 affords sufficient resilience so as to be self-supporting between the support arms 52 and 53. However, suitable support pins (not shown) may be provided to support the fin unit during the wrapping process. The outer surfaces 55 of both support arms have a convex curved configuration as illustrated in FIG. 9. Each of the support arms 52 and 53 has a plurality of sets of holes 56 formed in their outer surfaces 55 for indexing and maintaining the form devices 60 on the mandrel 40. The yoke 51 is coupled to a suitable drive mechanism 56 for rotation thereby.

Each of the form guide members 60 is a generally C-shaped member, of phenolic or other rigid plastic material, with its ends 61 and 62 offset laterally one from the other as illustrated in FIG. 12, defining skewed side surfaces 63 and 64 and a generally arcuate inner surface 65. The distance "s" between the centerline of end 61 and the centerline of end 62 corresponds to the amount of displacement of the return bend portion of the tube, which in turn corresponds to the spacing between the upper and lower slots (FIG. 7). In the exemplary embodiment, the spacing is one-half inch. The radius of curvature "r" of inner surface 65 of the form guide member 60 corresponds to the radius of curvature of the outer surfaces 55 of the mandrel support arms 52 and 53. The form guide member 60 includes a pair of laterally offset, horizontally extending pins 66 which are received in the holes 56 in the support arms 52 and 53. The form guide member 60 includes a metallic support plate 68 at its rearward side which interconnects the pins 66 and may cooperate with a positioning apparatus (not shown) to remove the form members from the mandrel after forming the return bends of the tube 22.

Referring to FIGS. 1, 2, 8 and 11–13, the form members 60 are mounted on the mandrel 40 prior to a tube wrapping operation. In the exemplary embodiment wherein the fin unit has four rows of notches provided on its upper surface and three rows notches provided on its lower surface, five form members are mounted on each of the two support arms 52 or 53 with their pins 66 extending into the corresponding pair of holes 56. The tolerance between the pins 66 and the holes 56 is such as to provide an interference fit. When the form members 60 are mounted on the mandrel 40, the mandrel curved outer edge surfaces 55 are received between ends 61 and 62 of the form members as shown in FIG. 13 for one of the form members 60. The form members 60 are spaced apart from one another laterally defining a generally diagonal space or channel 70 (FIG. 2) between one row of notches on the upper surface and an adjacent row of notches on the lower surface. The shape of the diagonal space 70 corresponds to the pitch of the return bends. A portion 55*a* of the curved edge 55 of the mandrel support arm between adjacent form members is exposed in the space 70 as illustrated in FIG. 13.

Referring to FIGS. 1 and 2, in manufacturing of the heat exchanger assembly 20 in accordance with the present invention, a fin unit 21 is mounted on the mandrel 40. Then the free end of the heat exchanger tube 22 is drawn manually from source 42 through the shaping apparatus 44 and laid in the first row of notches, and pushed thereonto. When the tube is seated in the first row of notches the tube is secured to the fin unit. Then the drive mechanism 56 is activated to rotate the mandrel 40 clockwise during the wrapping operation, as illustrated in FIG. 1, drawing the tube 22 from the source 42 of tubing. As the tube is drawn through the shaping apparatus 44, its cross section is formed to a generally oval shape as illustrated in FIG. 5.

As the mandrel reaches a vertical position, the guide arm 47 is moved to redirect the ovalized tube 22 through form members 60 which define the first return bend to orient the tube to be directed into the first row of notches on the lower surface of the fin unit as the mandrel 40 rotates. Referring to FIGS. 13A–13B, when the tube is initially positioned between form guides 60, as the mandrel approaches a vertical position, it is spaced from the surface 55*a* of the mandrel (FIG. 13A). As the mandrel rotates to a vertical position, the tube 22 is pulled against surface 55*a* (FIG. 13B). With continued rotation, tension on the tube 22 while it engages surfaces 55*a*, 63 and 64 causes deformation of the tube from its oval shape to square shape with inwardly directed ribs. (FIG. 13C). The controller 46 senses the end of the row of notches and raises the end of the tube and moves the end of the tube forward to the next row of notches on the lower surface of the fin unit which has rotated 180°. The wrapping process continues until the tube is wrapped around the fin unit 21 and is laid in each of the rows of notches. The tube pass portions 30 and 31 have the configuration illustrated in FIG. 5, and return bend portions 32 and 31 have the generally square configuration shown in FIG. 6.

Thus, the mandrel 40 rotates the fin unit 21 during wrapping of the tube 22 thereon, the support arms 52 and 53 cooperate with form guide members 60 to form the return bends 32 and 33 in the tube at its return bend portions. In accordance with a feature of the invention, the pass sections 30 and 31 of the tube 22 extending along both the upper end lower surfaces of the fin unit 21 are parallel to one another. The offset portions of the tube are formed only at the return bend portions of the tube at the edges of the fin unit. The form guide members 60 and the support arms 52 and 53 cooperate to maintain the return bend portions of the tube generally rectangular in cross section with the inwardly directed ribs in the tube provided as the result of the tension on the tube while it is being wrapped on the fin unit. The cross section of the return bends, illustrated in FIG. 6, becomes a generally square configuration, as illustrated in FIG. 15, after expansion of the tube. This results in the maximum cross section possible with controlled bending in assembling the tube with the fin unit 21.

After the tube 22 has been wrapped around the fin unit 21 and is laid in the notches 25 and 25*a*, the tube is severed from the supply, defining the fluid outlet 35.

Then, with the form guide members 60 still in place, a pushing device 72, (FIG. 14) is deployed to push the tube pass portions, seating them in the notches. The pushing device may be in the form of upper and lower magazines each including a plurality of tines 72*a* adapted to engage the tube along each of its pass portions 30 and 31 in each notch and urge the tube downwardly from the top (and upwardly from the bottom) into the circular portions of the notches 25 and 25*a* during expansion of the tube.

Then, the fluid outlet 35 of the tube 22 is closed and the tube is expanded by applying internal pressure to the tube through its fluid inlet 34. Pressure in the order of 400 to 900 psi is applied, simultaneously expanding the pass portions 30 and 31 and the return bend portions 32 and 33 of the tube 22. The pushing device 72 prevents the tube from expanding back into the narrow throat portions of the slots so that the resultant cross section of the pass portions 30 and 31 is generally "D" shaped as illustrated in FIG. 16. The form devices 60 and the curved surface portions 55*a* of the mandrel serve as form retainers to maintain the generally square cross section for the return bend portions 32 and 33 of the heat exchanger tube, illustrated in FIG. 15.

After the tube has been expanded, the pushing device 72 is retracted and the form guide members 60 are removed in a suitable manner either manually, or automatically as by coupling their metallic support plates 68 to a positioning apparatus (not shown). In the fin section it may be preferable to strike the tube a second time with device 72 to form the tube in the "D" shape if the pressure P is high for tube expansion. Because the form members 60 are made of phenolic or the like, their side surfaces 63 and 64 which are engaging the tube return bends are slippery, facilitating their removal. When the form guide members are removed, the heat exchanger assembly can be slipped off of the mandrel.

I claim:

1. In a method of making a heat exchanger assembly of the type including a heat transfer array having first and second parallel surfaces each defining a plurality of fins, each of the fins having notches which are aligned in sets on the first and second surfaces, the sets of notches on the first surface being offset relative to the sets of notches on the second surface and a single length of heat exchanger tube, wherein the tube is applied to the heat transfer array, threading the notches in the fins thereof, defining a first plurality of pass sections threading the notches on the first surface and a second plurality of parallel passes threading the notches on the second surface, and return bend portions interconnecting adjacent pass portions on the first and second surfaces, the improvement comprising:

producing relative rotation between the heat transfer array and the tube to cause the tube to be wrapped onto the heat transfer array;

indexing the tube relative to the heat transfer array as the tube is being wrapped thereon to direct the tube alternately into a set of notches on the first and second surfaces;

maintaining tension on the heat exchanger tube while it is being wrapped around the heat transfer array, threading the notches of the fins thereof to thereby produce a generally rectangular cross section for the tube in the return bend portions with a plurality of inwardly directing rib portions;

and, upon completion of the wrapping of the tube onto the heat transfer array, expanding the return bend portions to a generally rectangular shape to maximize the cross sectional area of the tube in the return bend portions.

2. The method according to claim 1 which includes rotating the heat transfer array about an axis while drawing the tube onto the heat transfer array.

3. The method according to claim 2 wherein indexing the tube includes monitoring the position of the tube as it is being laid in each set of notches in the heat transfer array and controlling a guide arm to redirect the tube relative to each set of notches in the heat transfer array as the heat transfer array is rotated about said axis.

4. The method according to claim 3 including moving the guide arm transversely of the heat transfer array a distance correlated with the amount of offset between sets of notches on the first and second surfaces of the heat transfer array.

5. The method according to claim 1 which includes reshaping the tube from a generally circular cross section to a generally oval cross section prior to wrapping the tube onto the heat transfer array.

6. The method according to claim 5 wherein the pass portions are expanded from a generally oval cross section to a generally circular cross section simultaneously with the expansion of the return bend portions.

7. The method according to claim 6 wherein indexing the tube includes providing forming means to define the pitch for each return bend portion for directing the tube between sets of notches on the first and second surfaces.

8. The method according to claim 7 which includes maintaining the forming means adjacent to each return bend portion of the heat exchanger tube during expanding of the tube.

9. The method according to claim 7 which includes removably mounting the forming means on a support structure which supports the heat transfer array while the tube is being wrapped thereon, and removing the forming means from the support structure after the return end portions have been expanded.

* * * * *